US012185901B2

(12) United States Patent
Laipple et al.

(10) Patent No.: US 12,185,901 B2
(45) Date of Patent: Jan. 7, 2025

(54) APPARATUS FOR COMPENSATING PRESSURE FLUCTUATIONS

(71) Applicant: Hilti Aktiengesellschaft, Schaan (LI)

(72) Inventors: Benno Laipple, Landsberg am Lech (DE); Felix Basalla, Ebhausen (DE); John Van Taack-Trakranen, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 173 days.

(21) Appl. No.: 17/632,713

(22) PCT Filed: Jul. 24, 2020

(86) PCT No.: PCT/EP2020/070971
§ 371 (c)(1),
(2) Date: Feb. 3, 2022

(87) PCT Pub. No.: WO2021/023525
PCT Pub. Date: Feb. 11, 2021

(65) Prior Publication Data

US 2022/0280003 A1 Sep. 8, 2022

(30) Foreign Application Priority Data

Aug. 5, 2019 (EP) ..... 19189940

(51) Int. Cl.
*A47L 9/24* (2006.01)
*A47L 9/00* (2006.01)

(52) U.S. Cl.
CPC ..... *A47L 9/248* (2013.01); *A47L 9/0072* (2013.01)

(58) Field of Classification Search
CPC ..... A47L 9/248; A47L 9/0072; A47L 9/20; E02F 3/88; E02F 3/902; E02F 3/9243;
(Continued)

(56) References Cited

U.S. PATENT DOCUMENTS 2,978,733 A 4/1961 Wahlborg
4,961,245 A * 10/1990 Barnes, Jr. ..... A47L 9/0081 D32/34
7,867,304 B2 1/2011 Stewen et al.
8,096,789 B2 1/2012 Weill
(Continued)

FOREIGN PATENT DOCUMENTS

CN 1988969 A 6/2007
CN 203178824 U 9/2013
(Continued)

OTHER PUBLICATIONS

Machine translation of JP2006102031A (Year: 2006).*
PCT/EP2020/070971, International Search Report dated Nov. 11, 2020 (Three (3) pages).

*Primary Examiner* — Eric J Rosen
*Assistant Examiner* — Robert C Moore
(74) *Attorney, Agent, or Firm* — Crowell & Moring LLP

(57) ABSTRACT

An apparatus for a vacuum cleaner for compensating air pressure fluctuations includes a main body through which an air flow is flowable in a flow direction, where the main body contains a passage opening, and a separating element, where the passage opening is separated from ambient air by the separating element. The separating element is movable such that, as a result of a movement of the separating element in a radial direction, a reservoir which receives an air volume is produced between the main body and the separating element such that a vacuum produced in the main body by the air flow is at least partially maintained.

6 Claims, 8 Drawing Sheets

(58) Field of Classification Search
CPC ..... E02F 3/9256; E02F 3/9293; E02F 3/94; E02F 5/108
USPC ..... 15/339; 138/45
See application file for complete search history.

(56) References Cited

U.S. PATENT DOCUMENTS

| | | | |
|---|---|---|---|
| 2008/0092498 | A1 | 4/2008 | Stewen et al. |
| 2013/0263406 | A1 | 10/2013 | Amisani et al. |
| 2016/0252914 | A1 | 9/2016 | Padgett et al. |
| 2017/0020352 | A1 | 1/2017 | Amisani et al. |

FOREIGN PATENT DOCUMENTS

| | | | | | |
|---|---|---|---|---|---|
| CN | 205481895 | U | | 8/2016 | |
| CN | 206234089 | U | | 6/2017 | |
| CN | 108895160 | A | | 11/2018 | |
| CN | 208313824 | U | | 1/2019 | |
| DE | 10 2005 017 702 | A1 | | 10/2006 | |
| DE | 10 2010 045 979 | A1 | | 3/2012 | |
| EP | 2 937 031 | A1 | | 10/2015 | |
| FR | 1 189 789 | A | | 10/1959 | |
| FR | 2 596 171 | A1 | | 9/1987 | |
| GB | 1 217 196 | A | | 12/1970 | |
| JP | S5595637 | U | * | 7/1980 | |
| JP | 0000S6445004 | U | * | 3/1989 | |
| JP | 64-45004 | U | | 3/1989 | |
| JP | H04121501 | U | * | 10/1992 | |
| JP | 11-76202 | A | | 3/1999 | |
| JP | 2006102031 | A | * | 4/2006 | ..... A47L 9/24 |
| JP | 2016-34484 | A | | 3/2016 | |

* cited by examiner

APPARATUS FOR COMPENSATING PRESSURE FLUCTUATIONS

BACKGROUND AND SUMMARY OF THE INVENTION

The present invention relates to an apparatus for a vacuum cleaner for compensating air pressure fluctuations, having a main body through which an air flow can flow in a flow direction.

Furthermore, the present invention relates to a vacuum cleaner hose having at least one apparatus for a vacuum cleaner for compensating air pressure fluctuations.

Prior art vacuum cleaners that are used in combination with a dust-producing power tool, especially hammer drills, grinders or saws, usually have a filter clearing system for occasional clearing of the filter in the vacuum cleaner. By means of occasional clearing, the functioning of the filter is maintained. In this case, filter clearing is accomplished by means of a brief and abrupt reversal of the pressure conditions upstream and downstream of the filter, which reverses the normal air flow through the filter to be cleaned. The air flow flowing counter to the usual flow direction, in the form of a pressure surge, has the effect that the accumulated dust and dirt falls out of the filter into a collecting container, with the result that the filter is then free again and thus has an improved filtering action. However, this causes a pressure fluctuation in the suction system.

The occasional clearing of the filter by means of the occasional abrupt reversal of the pressure conditions upstream and downstream of the filter can impair the suction capacity of the vacuum cleaner to such an extent that adequate aspiration of dust is no longer guaranteed.

It is thus the object of the present invention to provide an apparatus for a vacuum cleaner, and a vacuum cleaner hose having an apparatus for a vacuum cleaner, which solves the abovementioned problem and allows at least adequate aspiration of dust, even during the clearing of a filter.

In this case, the object is achieved by an apparatus for a vacuum cleaner for compensating air pressure fluctuations, having a main body through which an air flow can flow in a flow direction.

According to the invention, the main body contains at least one passage opening, and a separating element for separating the passage opening from ambient air is included, wherein the separating element is movable to ensure that a reservoir to receive an air volume is produced between the main body and the separating element, and a vacuum produced in the main body by the air flow is at least partially maintained.

According to an advantageous embodiment of the present invention, it may be possible for the separating element to be configured in the form of a flexible diaphragm. It is thereby possible in a simple way to provide a separating element which, on the one hand, precisely hugs the shape of an outer wall of the main body and, on the other hand, can produce a shape of a reservoir which is as variable as possible.

According to another advantageous embodiment of the present invention, it may likewise be possible for the separating element to be configured in the form of a piston-cylinder unit. It is thereby possible to produce a separating element that is as stable as possible, is very largely resistant to mechanical influences (e.g., shocks or impacts) and ensures reliable functionality.

According to an advantageous embodiment of the present invention, it may be possible for the separating element to be configured in the form of a plate that can be pivoted away from the main body. The plate that can be pivoted away can also be referred to as pivotable or rotatable (in the sense of capable of rotation). A separating element that is as stable as possible can likewise be provided by this means. Here, the embodiment of the separating element in the form of a plate that can be pivoted away need only be secured on the main body by a single hinge element, thus ensuring that a lower accuracy of fit is required in contrast to the embodiment as a piston-cylinder unit. The freely pivotable end of the separating element embodied as a plate that can be pivoted away can be secured on the outer wall of the main body by means of a diaphragm in such a way that an airtight seal is formed between the freely pivotable end of the separating element and the outer wall of the main body. Moreover, the embodiment as a plate that can be pivoted away ensures a certain robustness with respect to dust penetrating into the apparatus.

According to another advantageous embodiment of the present invention, it may furthermore be possible for the separating element to be configured in the form of a bellows.

According to an advantageous embodiment of the present invention, it may be possible for more than one main body to be included. It is thereby possible to variably increase the effect of compensation of air pressure fluctuations.

The object is furthermore achieved by a vacuum cleaner hose having at least one apparatus for a vacuum cleaner for compensating air pressure fluctuations, having a main body through which an air flow can flow in a flow direction.

Further advantages can be found in the following description of the figures. Various exemplary embodiments of the present invention are illustrated in the figures. The figures, the description and the claims contain numerous features in combination. A person skilled in the art will expediently also consider the features individually and combine them to form useful further combinations.

In the figures, components which are the same and components of the same type are denoted by the same reference signs.

DETAILED DESCRIPTION OF THE DRAWINGS

Figure 1A:
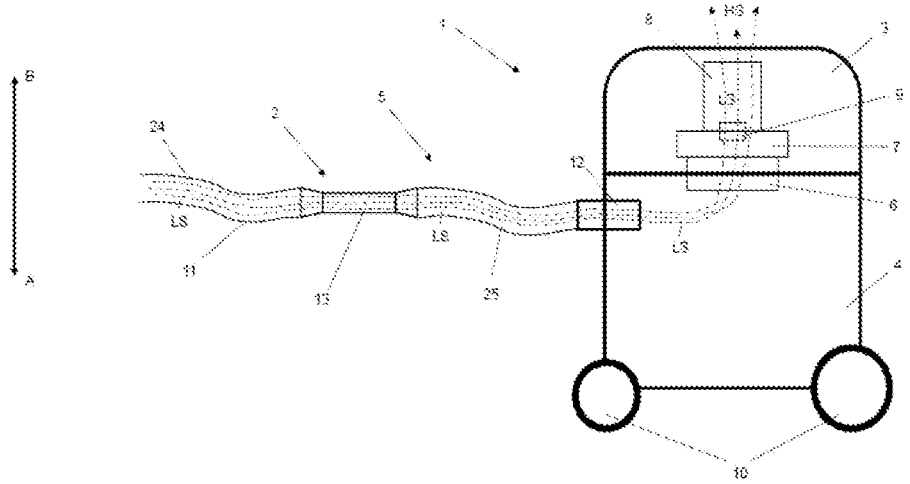
FIG. 1*a* shows a schematic side view of a vacuum cleaner having a vacuum cleaner hose according to the invention and having an apparatus according to the invention for compensating air pressure fluctuations, with the separating element in a first position, according to a first embodiment.
Figure 1B:
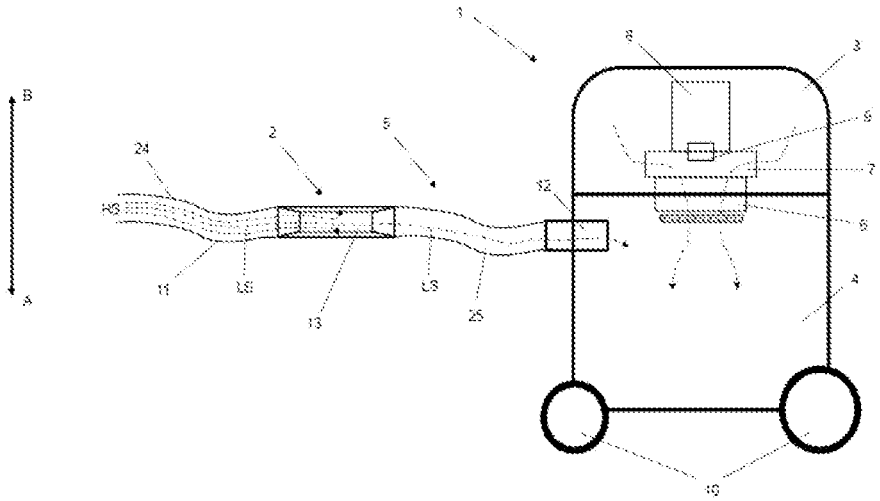
FIG. 1*b* shows a schematic side view of a vacuum cleaner having the vacuum cleaner hose according to the invention and the apparatus according to the invention for compensating air pressure fluctuations, with the separating element in a second position, according to the first embodiment.

FIGS. 1*a* and 1*b* show a vacuum cleaner 1 having an apparatus 2 for compensating air pressure fluctuations according to a first embodiment.

Here, the vacuum cleaner 1 substantially comprises a suction head 3, a storage container 4 and an intake device 5.

As can be seen from FIGS. 1*a* to 3, the suction head 3, in turn, substantially comprises a filter 6, a filter clearing device 7 and a turbine 8.

The turbine 8 serves to produce a vacuum, by virtue of which an air flow LS flows into the interior of the vacuum cleaner 1. By means of this air flow LS, dust particles and dirt particles can be sucked up and conveyed into the storage container 4 for storage.

The filter 6 serves to filter dust and dirt particles out of an air flow LS drawn in by the vacuum cleaner 1, and thus, inter alia, protects the turbine 8 from dust and contamination.

The filter clearing device 7 is designed to briefly and abruptly reverse the pressure conditions in the flow direction HS upstream and downstream of the filter 6. In other words: the air flow LS in the direction B is reversed into direction A. An air pressure surge produced thereby leads to clearing of the filter 6, as a result of which the dust and dirt accumulated in the filter 6 falls in direction A and into the storage container 4. As a result, the filter 6 once more becomes free and functional. By means of the filter clearing device 7, the air flow LS along the flow direction HS is then re-established. The functioning and, in particular, the readjustment of the filter clearing device 7 is controlled by a control device 9.

The storage container 4 is configured substantially as a container with a holding volume. Wheels 10 are provided on the underside of the storage container 4 configured as a container to ensure mobility of the vacuum cleaner. Only two wheels 10 are shown in the figures.

The intake device 5 substantially comprises a vacuum cleaner hose 11, a fastening element 12 and a nozzle. The nozzle may be, for example, a floor nozzle. The nozzle is not illustrated in the figures.

The fastening element 12 is configured substantially as a cylindrical tube and serves as an interface or connection for the vacuum cleaner hose 11 to the storage container 4.

Figure 4:
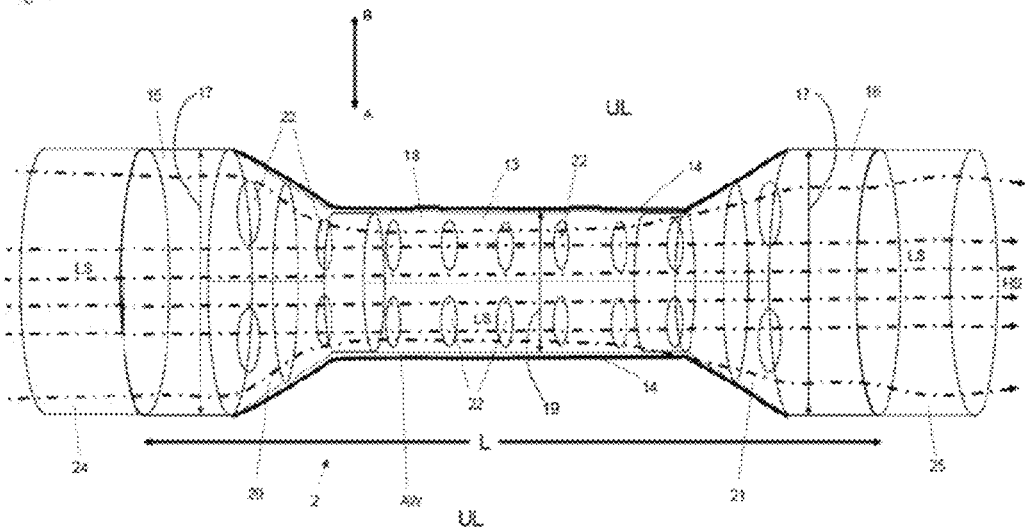
FIG. 4 shows a perspective view of the apparatus according to the invention for compensating air pressure fluctuations according to a first embodiment, with a separating element in a first position.
Figure 5:
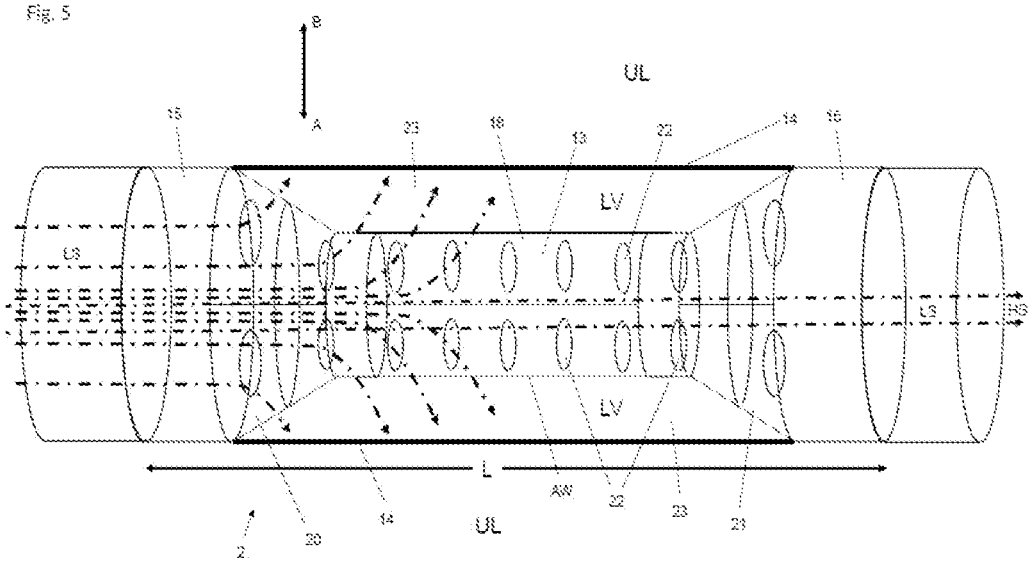
FIG. 5 shows a perspective view of the apparatus according to the invention for compensating air pressure fluctuations according to the first embodiment, with the separating element in a second position.

FIGS. 4 and 5 show the apparatus 2 for compensating air pressure fluctuations according to a first embodiment. In this case, the apparatus 2 substantially comprises a main body 13 and a separating element 14.

The main body 13 is configured substantially as a tube-like cylinder with a waisted region TB. The main body 13 thus contains a first region 15 and a second region 16 with a first cross-sectional area of flow 17 and a third region 18 with a second cross-sectional area of flow 19. The third region 18 is positioned between the first and the second region 15, 16. The transition 20 from the first region 15 to the third region 18, and the transition 21 from the second region 16 to the third region 18, are each of frustoconical configuration. The main body 13 furthermore contains a number of passage openings 22 along its entire length L. The passage openings 22 can also be referred to as through holes. Through the passage openings 22, air can flow from the interior of the main body 13 to the outside and from the outside into the interior of the main body 13.

According to the first embodiment, the separating element 14 is configured in the form of a hose composed of a flexible diaphragm, cf. FIGS. 4 and 5. Here, the separating element 14 configured as a diaphragm surrounds the region of the main body 13 which has the passage openings 22. The separating element 14 thus extends from the first region 15 to the second region 16 of the main body 13.

According to another advantageous embodiment, a multiplicity of raised portions in a radial alignment is arranged on the outer wall AW of the main body 13. The raised portions are not shown in the figures. The raised portions can be configured as ribs. The raised portions serve to ensure that, during the normal suction process, the separating element 14 configured as a diaphragm rests tangentially only against the raised portions, and the remaining outer wall AW of the main body 13 is not covered by the separating element 14. It is possible here for the passage openings 22 to be positioned only at the upper ends of the raised portions. As a result, the separating element 14 configured as a diaphragm is sucked against the main body 13 only in the regions of the raised portions during the normal suction process. This can lead to improved and greater uniform preloading of the separating element 14 configured as a diaphragm against the main body 13 during the normal suction process. Preloading of the separating element 14 in a manner which is as uniform as possible ensures a better suction function of the vacuum cleaner 1.

As illustrated in FIG. 1*a*, during the use of the vacuum cleaner 1 in the vacuum cleaning mode, an air flow LS flows in a flow direction HS from the floor nozzle (not shown) via the vacuum cleaner hose 11 through the apparatus 2 for compensating air pressure fluctuations, the storage container 4, the filter 6, and the turbine 8, and back out of the suction head 3 through outflow openings (not shown). In the vacuum cleaning mode, dust and dirt particles are thereby sucked out. In the vacuum cleaner mode, the air flow LS flows from a second end 16 of the main body 13, along the main body 13, to a first end 15 of the main body 13 (cf. FIG. 4). When the air flow LS is flowing through the apparatus along the flow direction HS, the separating element 14 configured as a flexible diaphragm is sucked against the outer wall AW of the main body 13 by the vacuum produced by the air flow LS, with the result that the separating element 14 rests closely against the outer wall AW of the main body 13 and, in doing so, covers the passage openings 22. The separating element 14 is in a first position, cf. FIGS. 1*a* and 4. During this process, the air flow LS is not significantly impaired, and dust continues to be sucked into the vacuum cleaner 1 by means of the air flow LS.

FIG. 1*b* shows the vacuum cleaner 1 in a filter clearing mode, by means of which the filter 6 is freed from the accumulated dust and dirt (as described above). By a brief reversal of the pressure conditions upstream and downstream of the filter 6, a pressure surge for clearing the filter 6 is produced.

As already described above, the clearing of the filter 6 in this way can impair the vacuum in the intake device 5 and, in particular, in the vacuum cleaner hose 11.

By virtue of the special configuration of the apparatus 2 for compensating air pressure fluctuations, the vacuum in the intake device 5 and, in particular, in the vacuum cleaner hose 11 is maintained in order to allow an uninterrupted suction process.

The preload on the separating element 14 configured as a flexible diaphragm falls, and it moves away from the outer wall AW of the main body 13 in a radial direction. The separating element 14 thus moves radially from the first position (cf. FIGS. 1*a* and 4) into the second position (cf. FIGS. 1*b* and 5). The movement of the separating element 14 results from the pressure difference between the still relatively low air pressure in the interior of the main body 13 and the atmospheric air pressure of the ambient air UL around the main body 13. As a result of the movement of the separating element 14 in the radial direction, a reservoir 23 for receiving an air volume LV is produced between the main body 13 and the separating element 14. The vacuum produced in the main body 13 by the air flow LS is thus at least partially maintained, and the suction process is continued.

As already mentioned above, FIGS. 1*a* and 1*b* show the first embodiment of the vacuum cleaner hose 11 according to the invention, wherein the apparatus 2 for compensating air pressure fluctuations is positioned between a first hose portion 24 and a second hose portion 25. The two hose portions 24, 25 are of substantially the same length.

Figure 2:
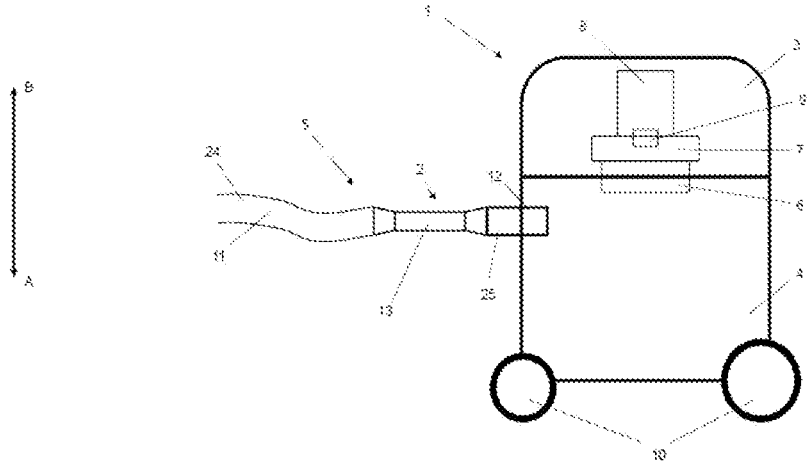
FIG. 2 shows a schematic side view of a vacuum cleaner having a vacuum cleaner hose according to the invention having an apparatus according to the invention for compensating air pressure fluctuations according to a second embodiment.

FIG. 2 shows a second embodiment of the vacuum cleaner hose 11 according to the invention, wherein the apparatus for compensating air pressure fluctuations is positioned between a first hose portion 24 and a second hose portion 25. In this case, the first hose portion 24 is longer than the second hose portion 25.

Figure 3:
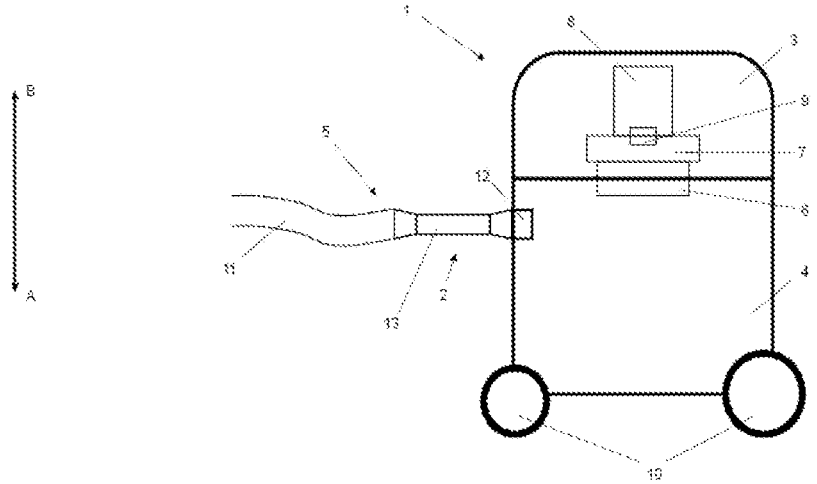
FIG. 3 shows a schematic side view of a vacuum cleaner having a vacuum cleaner hose according to the invention having an apparatus according to the invention for compensating air pressure fluctuations according to a third embodiment.

FIG. 3 shows a third embodiment of the vacuum cleaner hose 11 according to the invention, wherein the apparatus 2 for compensating air pressure fluctuations is positioned directly on the fastening element 12 for the storage container 4. There is thus only one hose portion.

Figure 6A:
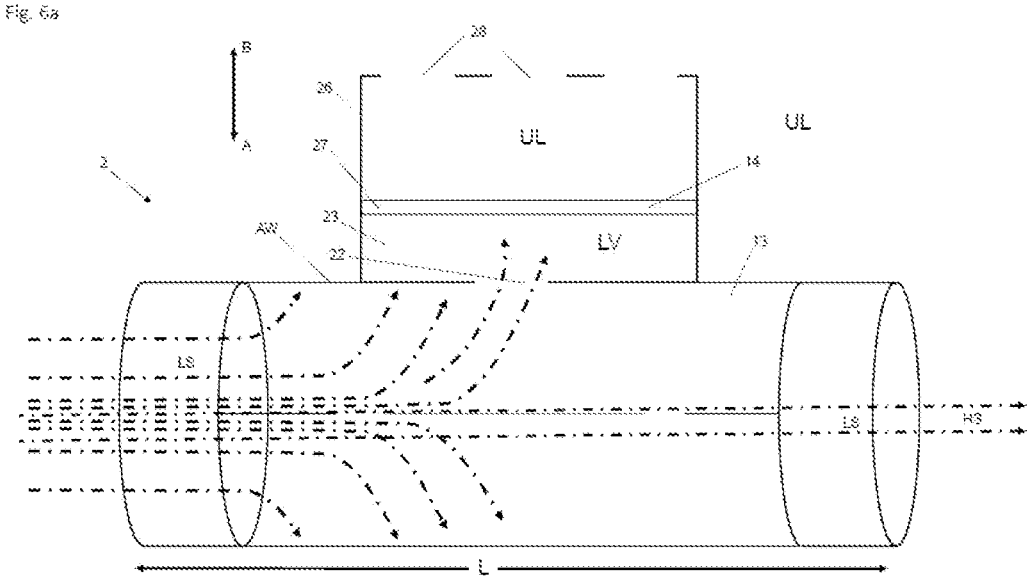
FIG. 6*a* shows a side view of the apparatus according to the invention for compensating air pressure fluctuations according to a second embodiment, with the separating element in the first position.

FIG. 6*a* shows another embodiment of the apparatus 2 for compensating air pressure fluctuations, in which the separating element 14 is configured substantially as a piston-cylinder unit. The separating element 14 configured as a piston-cylinder unit is connected to the interior of the main body 13 by a passage opening 22 in such a way that an air volume LV can flow out of the interior of the main body 13 into the cylinder 26 in the direction B. The pressure difference between the air pressure in the interior of the main body 13 and the ambient air UL ensures that the piston 27 is pushed in the direction B. Below the piston 27, in the direction A, the reservoir 23 for receiving an air volume LV is formed in the cylinder 26 between the main body 13 and the separating element 14. Openings 28 are provided at an upper end of the cylinder 26, with the result that the region above the piston 27 in direction B is filled with ambient air UL and an atmospheric air pressure.

Figure 6B:
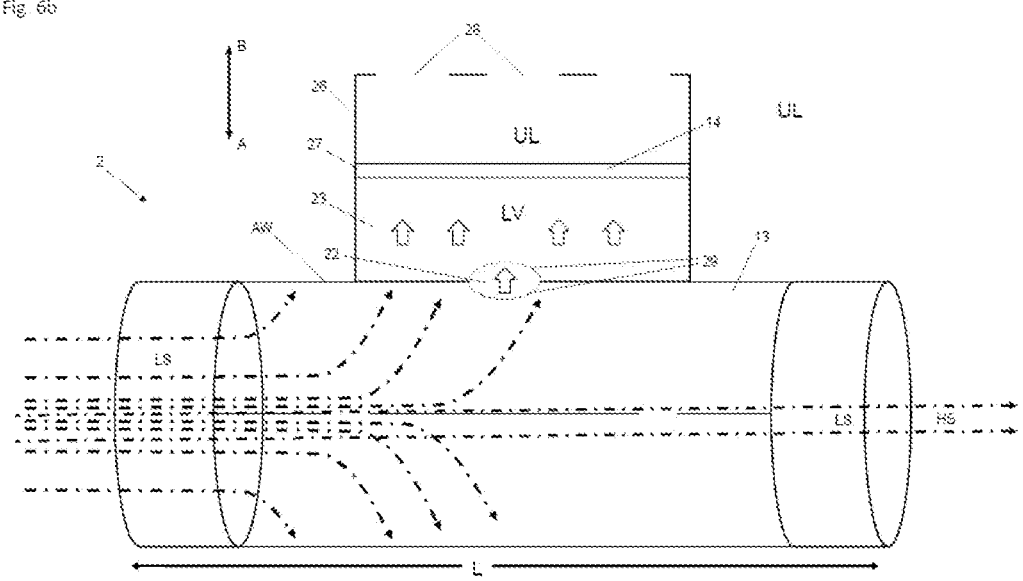
FIG. 6*b* shows a side view of the apparatus according to the invention for compensating air pressure fluctuations according to a third embodiment, with the separating element in the second position.

FIG. 6*b* shows another embodiment of the apparatus 2 for compensating air pressure fluctuations, in which, as in the embodiment in FIG. 6*a*, the separating element 14 is configured substantially as a piston-cylinder unit. As a difference with respect to the embodiment in FIG. 6*a*, the passage opening 22 between the main body 13 and the separating element 14 in the embodiment in FIG. 6*b* is closed by a flexible closure element 29.

According to an embodiment which is not shown in the figures, it is furthermore also possible for the apparatus 2 for compensating air pressure fluctuations to be positioned within the storage container 4.

LIST OF REFERENCE CHARACTERS

1 Vacuum cleaner
2 Apparatus for compensating air pressure fluctuations
3 Suction head
4 Storage container
5 Intake device
6 Filter
7 Filter clearing device
8 Turbine
9 Control device
10 Wheels
11 Vacuum cleaner hose
12 Fastening element
13 Main body
14 Separating element
15 First region of the main body
16 Second region of the main body
17 First cross-sectional area of flow
18 Third region of the main body
19 Second cross-sectional area of flow
20 Transition from the first region 15 to the third region 18
21 Transition from the second region 16 to the third region 18
22 Passage opening
23 Reservoir
24 First hose portion
25 Second hose portion
26 Cylinder
27 Piston
28 Openings
29 Closure element
AW Outer wall of the main body
L Length of the main body
LS Air flow
HS Flow direction
LV Air volume
UL Ambient air

The invention claimed is:

1. An apparatus for a vacuum cleaner for compensating air pressure fluctuations, comprising:

a main body having: a first region through which an air flow is flowable in a flow direction, and a passage opening; and a separating element that separates the passage opening from ambient air, wherein the separating element is movable in a radial direction to: (a) cover the passage opening in response to the air flow flowing in the flow direction, and (b) uncover the passage opening in response to the air flow flowing opposite the flow direction so as to thereby form a reservoir that receives an air volume produced between the first region and the separating element such that a vacuum produced in the first region by the air flow is at least partially maintained.

2. The apparatus as claimed in claim 1, wherein the separating element is a flexible diaphragm.

3. The apparatus as claimed in claim 1, wherein the separating element is a piston-cylinder unit.

4. The apparatus as claimed in claim 1, wherein the separating element is a plate that is pivotable away from the first region of the main body.

5. The apparatus as claimed in claim 1, further comprising a second region of the main body.

6. A vacuum cleaner hose, comprising:
the apparatus as claimed in claim 1.

* * * * *